United States Patent [19]

Boucherie

[11] Patent Number: 4,680,850

[45] Date of Patent: Jul. 21, 1987

[54] PROCESS FOR REMOVING THE WRAPPER FROM A FIBRE BUNDLE

[75] Inventor: Leonel Boucherie, Roeselare-Rumbeke, Belgium

[73] Assignee: Firma G.B. Boucherie, Belgium

[21] Appl. No.: 826,952

[22] Filed: Feb. 4, 1986

[30] Foreign Application Priority Data

Feb. 26, 1985 [BE] Belgium ..... 2/60629

[51] Int. Cl.[4] ..... B23P 19/00

[52] U.S. Cl. ..... 29/426.3; 29/426.4; 30/2; 83/23; 53/381 R; 300/9; 414/412

[58] Field of Search ..... 29/426.4, 426.3; 300/9, 300/10; 414/412; 53/381 R; 83/909, 924, 23; 30/2

[56] References Cited

U.S. PATENT DOCUMENTS

| | | | |
|---|---|---|---|
| 1,919,907 | 7/1933 | Robinson | 30/2 |
| 2,820,282 | 1/1958 | Schneeder, Jr. | 29/426.4 X |
| 3,386,320 | 6/1968 | Pinkham et al. | 414/412 X |
| 3,514,838 | 6/1970 | Freeborg | 29/426.4 |
| 3,521,347 | 7/1970 | Bentley | 29/426.3 X |
| 3,550,237 | 12/1970 | Metzger | 29/426.4 X |
| 3,785,026 | 1/1974 | Ohmstede | 29/426.4 X |
| 3,889,442 | 6/1975 | Grahn et al. | 53/381 R X |
| 3,949,890 | 4/1976 | Keller | 414/412 X |
| 4,414,730 | 11/1983 | Ohmura et al. | 29/426.3 |
| 4,430,039 | 2/1984 | Boucherie | 300/9 X |

*Primary Examiner*—Charlie T. Moon

*Attorney, Agent, or Firm*—Bacon & Thomas

[57] ABSTRACT

Process for removing the wrapper from a fibre bundle, characterized thereby that it mainly consists in successively gripping the fibre bundle (1) at the wrapper (2), freeing the embraced bundle of fibres (4) over a determined length from said wrapper (2), gripping said bundle of fibres (4) at the freed part and removing it from said wrapper (2), and carrying it away to a suitable arrangement, while the empty wrapper (2) is carried away as waste.

11 Claims, 11 Drawing Figures

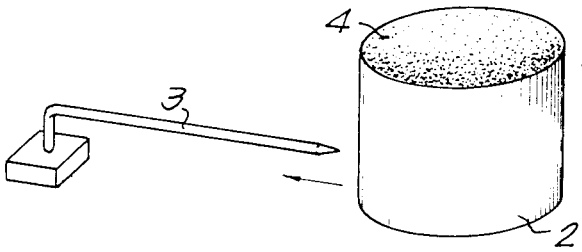
Fig. 1
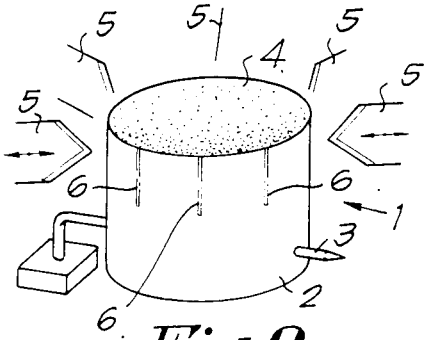
Fig. 2
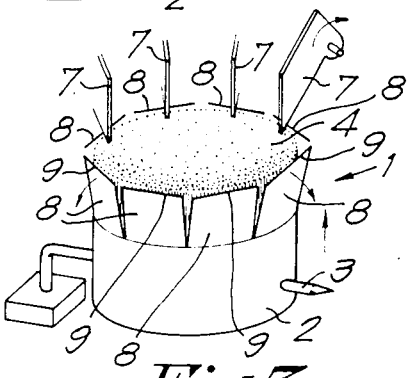
Fig. 3
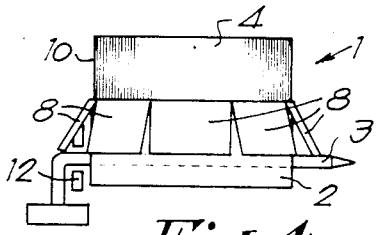
Fig. 4
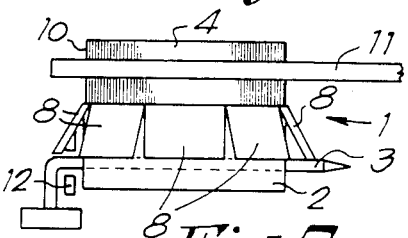
Fig. 5
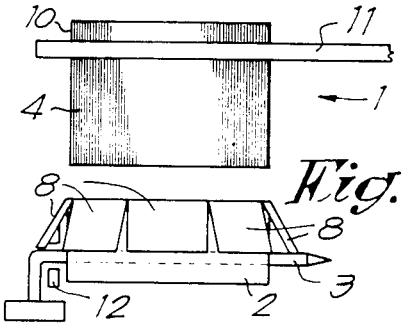
Fig. 6
Fig. 7
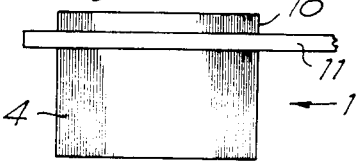
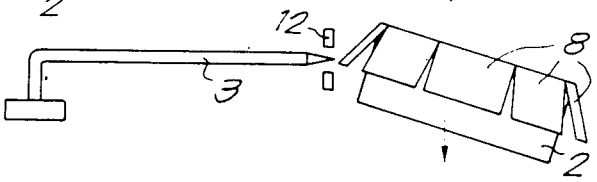

PROCESS FOR REMOVING THE WRAPPER FROM A FIBRE BUNDLE

This invention relates to a process for removing the wrapper from a fibre bundle, in other words to a process for removing the paper wrapper or the like from a fibre bundle in order to obtain a bundle of free fibres, that can then be supplied to a processing unit such as e.g. a brush-making machine.

It is generally known that fibres are transported in the form of fibre bundles from the fibre manufacturer to the brush manufacturer, such fibre bundles consisting of a bundle of loose fibres being held together by a wrapper which mainly consists of a paper strip or the like. So, various processes have been devised for removing automatically the wrapper from every fibre bundle in the brush-making process, wherein, however, each of the processes shows specific advantages as well as disadvantages. Such a process is known among other things from the Belgian Patent specification No. 901,006 of the applicant, the followed process mainly consisting in successively bringing the fibre bundles in a bundle chamber, completely cutting through the wrapper parallel to the fibres and pulling it away from under the fibres, gripping the bundle of loose fibres by means of a pair of gripping tongs, rotating it in a vertical position and placing it in a fibre magazine.

Although such a process has proved to be efficient in practice it shows the disadvantage that when the wrapper is removed often a number of the loose fibres are thrown into slight confusion or, in other words, are rotated relatively to the fibre direction of the fibre bundles, which in the further course of the production process results in an irregular disposition of a number of fibre packets in the brush bodies. Another disadvantage of this process is that the pair of fibre-gripping tongs, which brings the fibres into the fibre magazine after the removal of the wrapper, has to make a cumbersome angular rotation since at one hand the wrapper can only be removed if the fibre bundle is lying in such a way that the fibres extend horizontally, and on the other hand the bundles of loose fibres by means of the pair of gripping tongs have to be placed substantially vertically in a fibre magazine.

In order to do away with these disadvantages the present invention provides a completely new process for removing the wrapper, wherein all fibres remain perfectly parallel to one another and the operations to be carried out are considerably simpler than in the above-mentioned process. The present invention solves this problem in that the fibres are held fast in the wrapper until they are gripped by the pair of fibre-gripping tongs.

So, the process for removing the wrapper from a fibre bundle according to the present invention mainly consists in successively gripping the fibre bundle at the wrapper, freeing the embraced bundle of fibres of the wrapper over a certain length, gripping the bundle of fibres at the freed part, removing it from the wrapper and carrying it away to a suited arrangement, while the empty wrapper is carried away as waste.

The invention also relates to an arrangement for realizing the abovesaid process for removing the wrapper from a fibre bundle. More especially it relates to a fibre-feeding arrangement for use in brush-making machines wherein the fibre bundles are taken automatically from a fibre-bundle magazine, the wrapper is removed, wherein a pair of fibre-gripping tongs grips the bundle of fibres and at last places it in a fibre magazine.

In order to better disclose the features of the present invention the process as well as a preferred embodiment of an arrangement for carrying it out are described hereinafter without limiting it thereto and are represented by means of the accompanying drawings wherein:

FIGS. 1 to 7 stepwise illustrate the process according to the invention;

Figure 8:
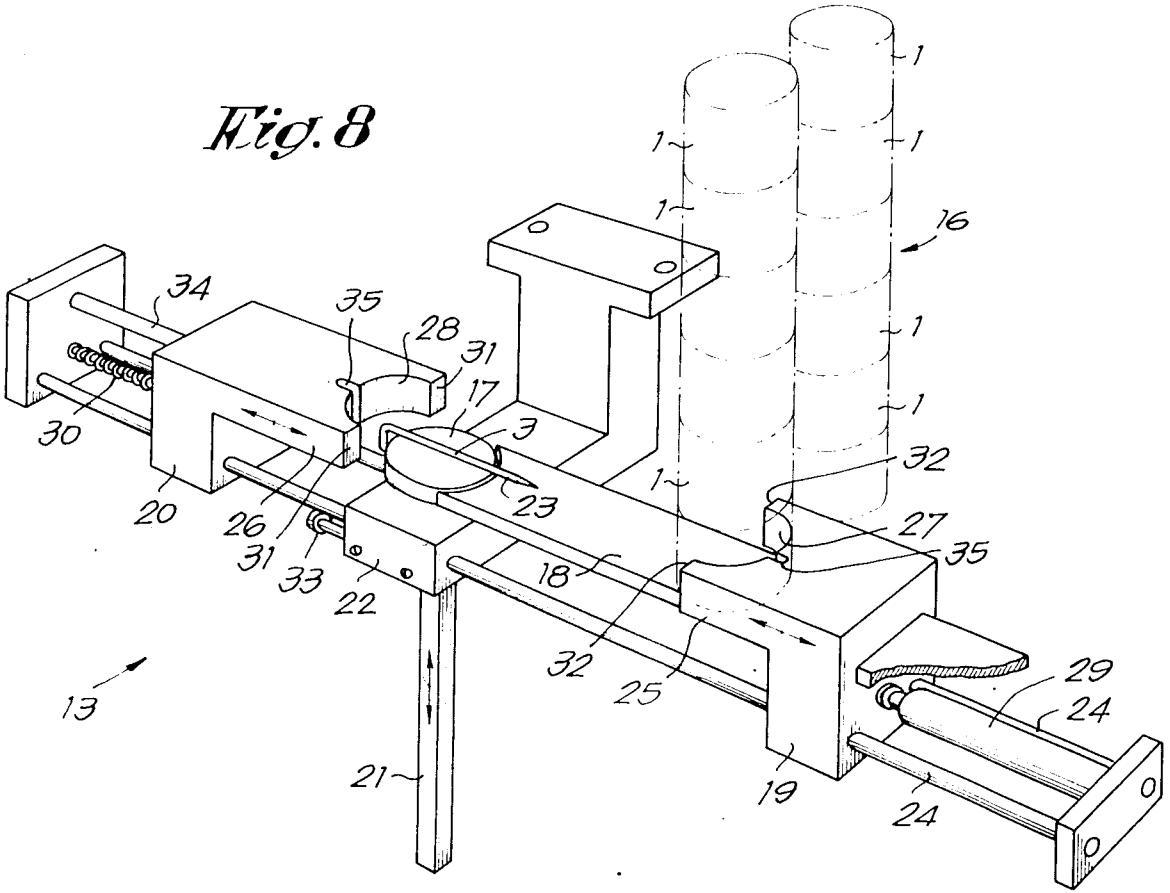
FIG. 8 represents a perspective view of a first part of the arrangement according to the present invention.

First the process for removing the wrapper from a fibre bundle according to the present invention is now described by means of FIGS. 1 to 7.

In a first step of this process, as is represented in FIGS. 1 and 2, a fibre bundle 1 is gripped or clamped at its wrapper 2, said fibre bundle preferably standing upright and gripping taking place in the undermost part of wrapper 2. For that purpose, as is represented in the figures, a pin 3 is applied right to the wrapper 2 and the fibres 4 of the fibre bundle 1, either by putting said pin 3 through it, or by sliding fibre bundle 1 over pin 3, or by providing a combination of both actions. Naturally pin 3 is secured to a part of the arrangement according to the present invention.

Obviously, gripping fibre bundle 1 at its wrapper 2 can occur in still other ways, e.g., by allowing a number of short pins, that are distributed along the periphery of fibre bundle 1, to act radially with respect to the latter in wrapper 2.

Then, as also represented in FIG. 2, wrapper 2 is cut partially through at at least two, but preferably at eight places according to a direction running almost parallel to the direction of fibres 4. This occurs, e.g. by allowing a number of knives 5 to act radially at the suited places on fibre bundle 1, all this in such a way that the desired cuts 6 in wrapper 2 are obtained.

In a next step of the process according to the invention the cut through part of wrapper 2 is partly or completely folded so that the fibres 4 are partly freed. This is represented in FIGS. 3 and 4 wherein folding of the cut through part of wrapper 2 takes place by way of example by means of a number of hinged small arms 7 each of which folding one of the strips 8 of the cut through part of wrapper 2. This occurs by moving down said arms 7 and allowing them to act behind the upper rim 9 of the wrapper, or by raising pin 3 with the fibre bundle 1 attached thereto vertically with respect to said arms 7.

By this action end 10 of fibre bundle 1 is freed, whereas the other part of it is still contained in wrapper 2, which has the important advantage that all of the fibres 4 are still parallel.

In a next step of the process, which is represented in FIG. 5, the free end 10 of fibre bundle 1 is gripped by means of a pair of fibre-gripping tongs 11 or the like. As is represented in FIG. 6, either by raising said pair of fibre-gripping tongs 11 or by allowing pin 3 with wrapper 2 stuck on it to go down, the fibres 4 come completely free from said wrapper 2 and are held fast parallel to each other in the pair of fibre-gripping tongs 11, whereupon the latter is to place the bundle of fibres 4 automatically in a fibre magazine or the like.

In a last step of the process the empty wrapper 2 is removed from the applied arrangement. If a pin 3 was used as mentioned above, this can occur—as is represented in FIGS. 6 and 7—by means of a stop 12 which strips the paper wrapper 2 from said pin 3, which takes place by making one of both parts, either pin 3 or stop 12, slide with respect to the other one.

Of course the process described above can be carried out fully automatically.

A preferred embodiment of a fibre-feeding arrangement for realizing the abovesaid process is described hereinafter by means of the FIGS. 8 to 11.

The arrangement according to the present invention mainly consists of a clamping part 13 for gripping a fibre bundle 1 at its wrapper 2, a cutting part 14 for applying the abovesaid cuts 6, and a folding part 15 for bending the strips 8. The arrangement also comprises a bundle magazine 16 and the said pair of fibre-gripping tongs 11.

The clamping part 13, which is specifically represented in FIG. 8, mainly consists of an upward and downward movable platform 17 to which pin 3 is fixed, a slideway 18 whose upper surface lies in the same plane as the upper surface of said platform 17 if the latter is in its lowest position, and at least one slide 19 that can be moved to and fro over said slideway 18. According to this embodiment there is still a second slide 20 as well as the abovesaid bundle magazine 16.

The platform 17 is circular and has a diameter practically equal to the diameter of a fibre bundle 1 and is supported by a driving rod 21 which can be moved vertically upward and downward in a frame 22 by means of a driving mechanism (not represented) such as a pneumatic cylinder. Pin 3 extends itself over the whole platform 17 in a direction parallel to the longitudinal axis of slideway 18, said pin 3 being at a small height above the upper surface of platform 17 and point 23 of it pointing to slide 19 which can be moved along slideway 18.

Said slides 19 and 20 can be moved to and fro along a number of guides 24. Both slides 19 and 20 possess a protruding part 25 and 26 respectively which can come into contact with one another when the slides are moving toward each other and each of said parts is provided with a semicircular cut-out 27 and 28 respectively, whose dimension is such that they can embrace a fibre bundle when both slides 19 and 20 come into contact.

Slide 19 is moved to and fro along slideway 18 by means of a cylinder 29 in such a way that in the one uttermost position of slide 19 the semicircular cut-out 27 of it is presented under one of the exits of bundle magazine 16, whereas in the other uttermost position of slide 19 the protruding part 25 reaches to just before platform 17. In the figures, bundle magazine 16 is represented only schematically.

It is of a type known by itself and consists occasionally of a plurality of bundle channels parallel to one another, as well as of a not represented stopping mechanism for making fibre bundles 1 fall one by one onto slideway 18 at the desired moments.

In the situation represented in FIG. 8 the second slide 20 normally finds itself with its protruding part 26 completely above platform 17 and more especially it covers pin 3 completely. For clarity's sake, however, said slide is represented in an advanced position. Said slide 20 is provided with a spring 30 taking care that slide 20 is pushed with its protruding part 26 over platform 17 and, if not, the ends 31 of the protruding part 26 are pushed as far as against the ends 32 of the protruding part 25 of the first slide 19. The movement of the second slide 20 is determined by two fixed stops 33 and 34 respectively, the first stop 33 being mounted in such a way that the protruding part 26 of the concerned slide covers pin 3 completely, whereas stop 34 is placed in such a way that the cut-out 28 practically coincides with the rim of platform 17.

In the position in which at one hand both slides 19 and 20 are against one another and on the other hand the second slide 20 is also pushed against stop 34, the opening formed by both the semicircular cut-outs 27 and 28 offers enough space to give platform 17 free passage in its vertical movement.

In the protruding parts 25–26 vertical grooves 35 are provided for allowing pin 3 to pass during the upward displacement of said platform 17.

In a preferred variant, both of the protruding parts 25 and 26 too are provided at their underside of a similar groove, whereby it becomes possible for the undersides of the protruding parts 25 and 26 to be slided just above slideway 18 and platform 17 respectively.

Figure 9:
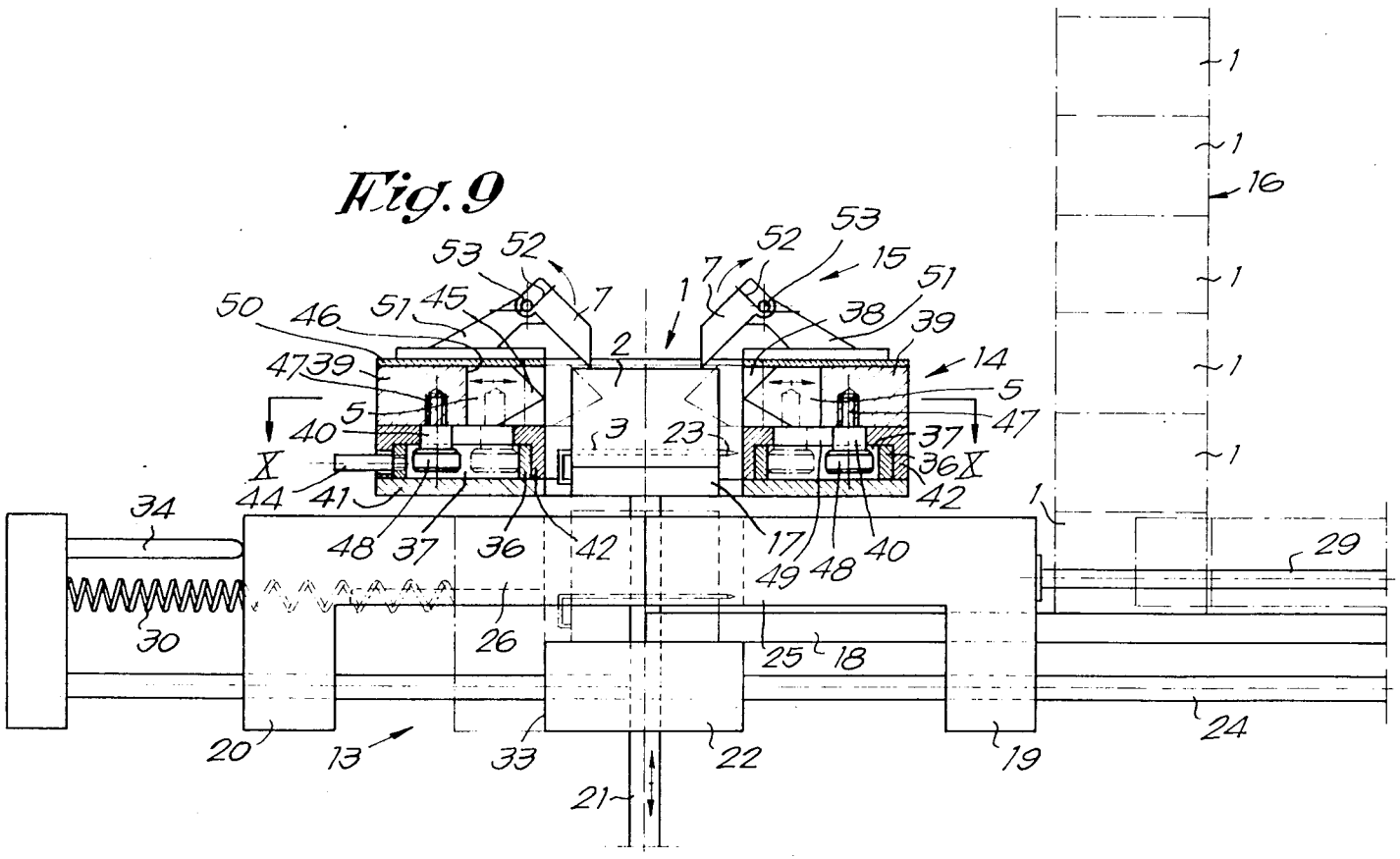
FIG. 9 represents a partly section and front view of the arrangement according to the present invention, the partly cutting through of the wrapper of the fibre bundle being represented schematically.
Figure 10:
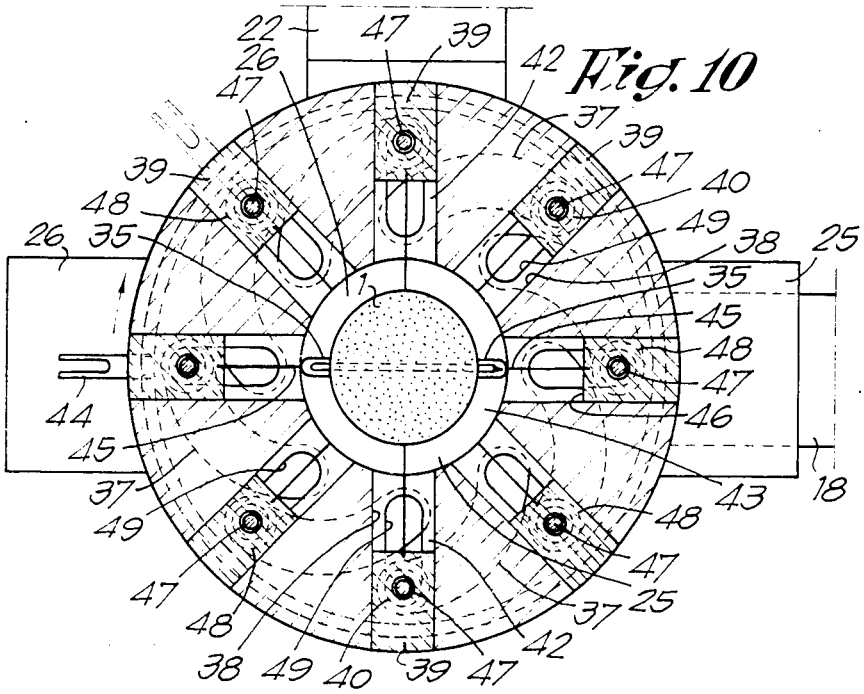
FIG. 10 represents a section according to line X—X in FIG. 9.

As represented in FIGS. 9 and 10, cutting part 14 mainly consists of a rotatable flat ring 36 which is provided with a number of guide-forming grooves 37 of spiral shape, a number of radially running guideways 38 provided above them, and pads or guiding shoes 39, which at one hand are contained in these guideways 38 and on the other hand make a sliding or rolling contact with the grooves 37 of spiral shape by means of pins 40.

Ring 36 is ratatable around its axis of symmetry and for that purpose, according to this example, is contained between a bottom plate 41 and a casing 42 mounted thereon, the guideways 38 also being applied in the latter. The central opening 43 of ring 36 is right above platform 17 and has a diameter a little greater than the diameter of the fibre bundles 1 to be treated.

Ring 36 is provided with a driving mechanism not represented in the figures in order to rotate it to and fro over a determined angle. Such can occur, e.g., by making a driving mechanism of any kind act on the periphery of ring 36, which, e.g., consists of a fork 44 fixed to the ring 36, on which a pin can act that is mounted on a piston rod. As a matter of fact many variants are possible.

The above named knives 5 are mounted on the guiding shoes 39. Said knives 5 consist of small plates in a vertical plane which are suitably provided with a knife point 45, said plates being mounted on the inwards directed sides 46 of said guiding shoes 39 in such a way that they can be entered into and removed from the central opening 43 by a radial displacement of the guiding shoes 39.

Pins 40 which take care that the guiding shoes 39 move according to the locus determined by the intersection of the spiral-formed guide-forming grooves 37 and the radially directed guideways 38, according to this embodiment are provided at one end with a threaded portion 47 and at their other end with a small roller 48. The threaded part 47 is screwed in the guiding shoes 39. The proper pins 40 reach as far as in the spiral-formed grooves 37 of ring 36 through radial grooves 49 applied in casing 42. By the use of rollers 48 a perfect guiding of pins 40 in the grooves 37 is obtained. The guideways 38 are closed at the top by means of a cover 50 which is applied to the casing 42.

The folding part 15 of the arrangement according to the present invention mainly consists of the above said small arms 7 which extend radially and transversally in the extension of said central opening 43 and for that purpose are hinged on supports 51 that are fixed to the cover 50.

The arms 7 mainly extend themselves downward under an angle of inclination of 45°, at least in position of rest and are always being pushed to such position by means of torsion springs 52 that are provided in the pivots 53.

The cutting part 14 and the folding part 15 are carried by said bottom plate 41 which is fixed to frame 22.

Further there is of course the pair of fibre-gripping tongs 11 which acts in a horizontal plane extending at a small distance above said folding part 15.

Figure 11:
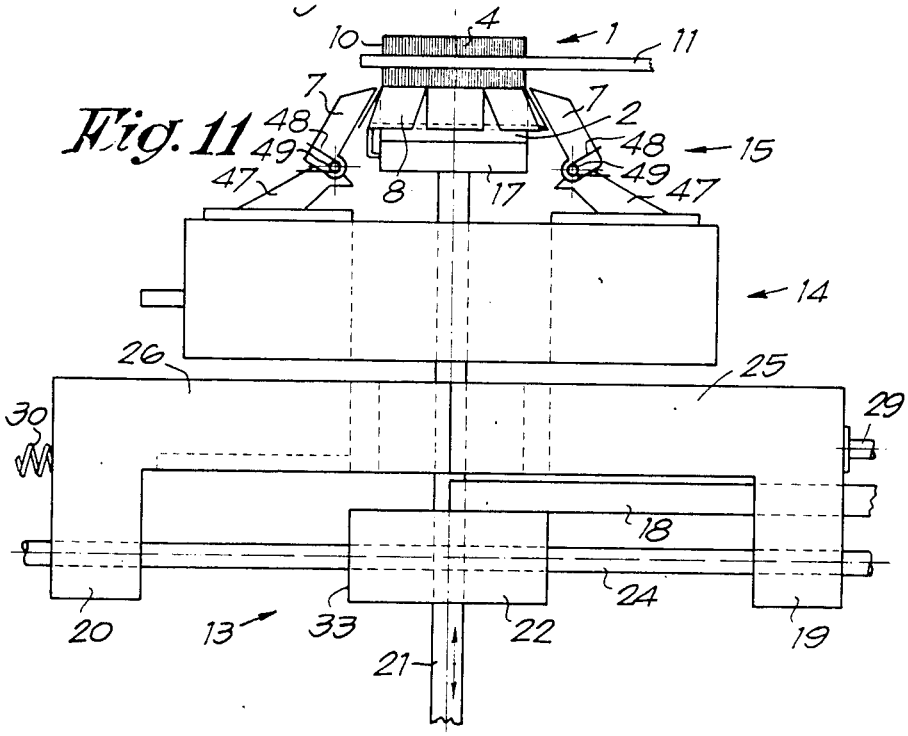
FIG. 11 represents a view analogous to that of FIG. 9, but in a position of the arrangement while a part of the wrapper, is being folded.

Platform 17 is connected to a suitable driving mechanism, not respresented in the figures, by means of the driving rod 21, which allows a vertical three-position adjustment of said platform 17, which driving mechanism is realized, e.g., by means of a usual pneumatic three-position regulation by providing two pneumatic pressure cylinders in series. As represented in FIG. 8, platform 17 finds itself in a first position with its upper surface at the same level as the upper surface of slideway 18. In a second position, platform 17 is brought at such a height that a fibre bundle 1 being thereon is presented with its upper half part between the knives 5 as is represented in FIG. 9. In a third and highest position platform 17 is practically at the height of the pivots 53 of arms 7 so that a situation is obtained as represented in FIG. 11.

Naturally the arrangement is provided with a fully automatic driving mechanism, steering taking place in such a way that the various parts move according to an operation pattern which is described below. All driving mechanisms can be of pneumatic as well as of any other usable nature, whereby tha man skilled in the art can use driving elements known by themselves, such as e.g. pressure cylinders and compressed-air valves.

The operation of the arrangement is as follows. If the arrangement is out of operation, the slide 19 that can move to and fro along slideway 18 is in a position as represented in FIG. 8. At that moment the second slide 20 is pushed by means of the spring force of spring 30 with its protruding part 26 as far as over the platform 17, which of course is in its lowest position. In a first action a fibre bundle 1 from the bundle magazine 16 is automatically deposited by steering on the glideway 18, more especially before the semicircular cut-out 27 of slide 19. Then cylinder 29 goes out and presses slide 19 as well as the fibre bundle 1 before it towards the second slide 20, whereby finally said fibre bundle 1 is completely enclosed by said slides 19 and 20 when the ends 31 and 32 of the protruding parts 25 and 26 of said slides come into contact. Both slides are then further moved by means of cylinder 29 until the second slide 20 comes into contact with stop 34. Upon reaching said stop 34, fibre bundle 1 occupies its place on platform 17 and pin 3 has penetrated completely through the wrapper 2 and the fibres 4 contained therein during the above movement.

Platform 17 is then brought in its second position, in other words fibre bundle 1 is presented between the knives 5. At that moment the guiding shoes 39 as well as the knives 5 fixed thereto are in a position as represented in FIG. 9. While the fibre bundle is in the central opening 43, ring 36 is rotated over a determined angle by a suitable driving mechanisn, whereby the pins 40 are radially moved inwards by means of the spiral-formed grooves 37 resulting therein that said knives 5 penetrate through the wrapper 2 and therein bring about said cuts 6. This latter position is represented in dotted line in FIG. 9.

Thereafter ring 36 is rotated back in its original position whereby the knives withdraw themselves.

In a following movement, platform 17 is brought to its highest position, whereby the arms 7, which radially extend themselves to within the mantle surface of wrapper 2, act behind said strips 8 and fold them while they are assisted by the spring pressure of the torsion springs 52. Every strip 8 is folded thereby by an arm 7. So, the end 10 of the fibre bundle 1 concerned comes completely free and said bundle 1 can be gripped in a horizontal plane by means of the pair of fibre-gripping tongs 11. Then either said pair of fibre-gripping tongs 11 moves upward after gripping the fibres 4, or platform 17 with the wrapper 2 fixed thereon moves downward resulting therein that all of the fibres 4 remain perfectly parallel in said pair of fibre-gripping tongs 11, whereupon the latter places the bundle of loose fibres 4 in a fibre magazine or the like.

The fibre-feeding arrangement is then brought back in its position of rest by first bringing said platform 17 back in its lowest position and then withdrawing the first slide 19. Hereby the empty wrapper 2 is stripped from pin 3 by means of the second slide 20 and the spring pressure exerted thereon by spring 30 and removed from the slideway 18 in any way.

In a variant, said slideway 18 is not rigidly attached to frame 22 but with the help of some friction can slide in slide 19 driven by means of cylinder 29. Thereby is achieved that during the application of a fibre bundle 1 to platform 17 the operation remains analogous to the one described above, but during going back the slideway 18 is caught in this movement because of the friction in slide 19, whereby a free space is created besides platform 17 through which space the wrapper 2 can fall down. It is clear that a stop has to be provided indeed at a determined distance behind the slideway 18 at the opposite side of platform 17 in order to detain the slideway in its movements in good time before slide 19 comes in its withdrawn uttermost position, so that a surface is generated on which the following fibre bundle 1 can be deposited.

Obviously, such an arrangement can be carried out according to many variants without departing from the scope of the invention, e.g., pin 3 can be replaced by two or more pins extending besides one another in a horizontal plane so as to exclude the chance that a fibre bundle 1 be pushed besides pin 3.

Self-evidently also other arrangements can be used for making knives 5 act on a part of the wrapper 2, while also the number of knives used herein may be different but preferably amounts to eight. The same applies to the arms 7. It should be remarked that for clarity's sake only two of such arms 7 have been represented in the figures, but that in reality their number is eight.

In a preferred variant the semicircular cut-outs 27–28 are replaced by angular cut-outs so that fibre bundle 1 upon being applied between the protruding parts 25–26 of the slides is pressed in the form of a polygon, the number of sides of this polygon corresponding with the number of arms 7. Such an arrangement has the advantage that the strips 8 can be folded very easily.

The present invention is by no means limited to the embodiment described as an example and represented in the accompanying drawings. Such a fibre-feeding arrangement, more especially an arrangement for removing the wrapper according to the process of the present invention can be realized in any forms and dimensions whatever without departing from the scope of the invention.

I claim:

1. Process for removing the wrapper from a fibre bundle, characterized thereby that it mainly consists in successively gripping the fibre bundle (1) at the wrapper (2), freeing the embraced bundle of fibres (4) over a determined length from said wrapper (2), gripping said bundle of fibres (4) at the freed part and removing said fibre bundle from said wrapper (2), and carrying said fibre bundle away to a suitable arrangement, while the empty wrapper (2) is carried away as waste.

2. Process according to claim 1, characterized thereby that the bundle of fibres (4) is partly freed by making at least two cuts (6) in said wrapper (2) so as to form a number of strips (6), which are folded afterwards.

3. Process according to claim 2, characterized thereby that said cuts (6) are applied mainly according to a direction parallel to the direction of said fibres (4) at practically equal common distances along the periphery of said fibre bundle (1).

4. Process according to claim 2, characterized thereby that said cuts (6) are applied to an axial end of said fibre bundle (1), the length of the latter substantially corresponding to half the length of a fibre (4).

5. Process according to claim 1, characterized thereby that said bundle of fibres (4) is removed from said wrapper (2) by axially sliding it out thereof.

6. Process according to claim 1, characterized thereby that the removal of said bundle of fibres (4) from said wrapper (2) is realized by sliding said wrapper (2) axially off said bundle of fibres (4).

7. Process according to claim 1, characterized thereby that gripping said fibre bundle (1) at said wrapper (2) is realized by applying at least one pin (3) right through said wrapper (2) into the bundle of fibres (4) embraced thereby.

8. Process according to claim 3, characterized thereby that said cuts (6) are applied by making a number of knives (5), which extend themselves according to an axial plane with respect to said fibre bundle (1), radially penetrate into said wrapper (2) practically simultaneously.

9. Process according to any of claim 2, characterized thereby that folding said strips (6) takes place by bending them by means of small arms (7).

10. Process according to claim 1, characterized thereby that gripping said bundle of fibres (4) at its freed part is realized by embracing said part by means of a pair of fibre-gripping tongs (11).

11. Process according to claim 10, characterized thereby that removing said bundle of fibres (4) from said wrapper (2) is realized by moving said pair of fibre-gripping tongs (11) in closed condition axially with respect to said wrapper (2).

* * * * *